United States Patent [19]

Mizuno

[11] 4,232,306

[45] Nov. 4, 1980

[54] SUPERVISORY CONTROL SYSTEM AND APPARATUS

[75] Inventor: Shuzo Mizuno, Tokyo, Japan

[73] Assignee: Kabushiki Kaisha Kogen, Tokyo, Japan

[21] Appl. No.: 942,420

[22] Filed: Sep. 14, 1978

[30] Foreign Application Priority Data

Sep. 20, 1977 [JP] Japan ..... 52-112170
Dec. 30, 1977 [JP] Japan ..... 52-158948

[51] Int. Cl.[2] ..... G08B 29/00

[52] U.S. Cl. ..... 340/506; 340/517; 179/1 MN; 179/5 P

[58] Field of Search ..... 340/501, 506, 517, 521, 340/552; 179/1 MN, 5 P

[56] References Cited

U.S. PATENT DOCUMENTS 3,662,112 5/1972 Martin ..... 340/506
4,138,674 2/1979 Humphries ..... 340/506

*Primary Examiner*—Alvin H. Waring
*Attorney, Agent, or Firm*—Blanchard, Flynn, Thiel, Boutell & Tanis

[57] ABSTRACT

A supervisory control system and apparatus used in a fire prevention system, a burglar alarm system, a remote control system, etc., in which progressive operation by continual selective signals is performed using a series of operating units in order to supervise and control each unit.

11 Claims, 6 Drawing Figures

SUPERVISORY CONTROL SYSTEM AND APPARATUS

BACKGROUND OF THE INVENTION

This invention relates to a supervisory control system and apparatus used in a fire prevention system, a burglar alarm system, a remote control system, etc..

In a fire prevention system, sensors, alarm devices and actuators are used in order to drive fire prevention devices such as shutters, duct dampers, blowers and so on. For the purpose of supervisory control of these devices, a plurality of operating units are used. The conventional system and apparatus for supervisory control need complicated devices and a plurality of wires in order to supervise which sensor or actuator has functioned and control a certain actuator.

BRIEF SUMMARY OF THE INVENTION

It is, therefore, an object of the present invention to provide a system and an apparatus for supervisory control which make supervisory control possible by a simple operation, simple devices and a few wires.

It is another object of this invention to provide a system and an apparatus for supervisory control capable of automatic control by a sensor signal from a sensor and of remote control by a selective signal from a control port.

It is also an object of this invention to provide a system and an apparatus for supervisory control in which it is possible not to activate a load immediately when a sensor has functioned, and to activate the load after confirmation of the matter.

It is still another object of this invention to provide a system and an apparatus for supervisory control, in which a supervisory signal of display passes through an unused line, during a supervision.

These and other objects of the invention will appear more clearly from the following specification with the accompanying drawings.

The supervisory control system of the present invention comprises a plurality of sensors; an alarm devices for providing an alarm from activation of a sensor; a series of operating units comprising a relay for activating a load and transfer means for transferring the operatable state of the unit, the relay being activated by a selective signal and/or a sensor signal, and the transfer means being to allow the operation of the operating unit in question by a selective signal and to make possible the operation of the next operating unit by the next selective signal; means for transmitting continual selective signals to the operating units; and means for displaying information transmitted from the operating unit during the operation.

The transfer means prevent the operation of the other operating units during the operation of the unit to which the means belong. The operating unit further comprise a load for activating a driving device and means for transmitting a supervisory signal during the operation of the unit. The transfer means may comprise a two-coil type self-maintaining relay having a transfer contact which changes over by the transmission and/or the interruption of a selective signal.

In the system of the present invention, progressive operation by transmitting continual selective signals is performed in order to supervise and control each operating unit.

DETAILED DESCRIPTION

Figure 1:
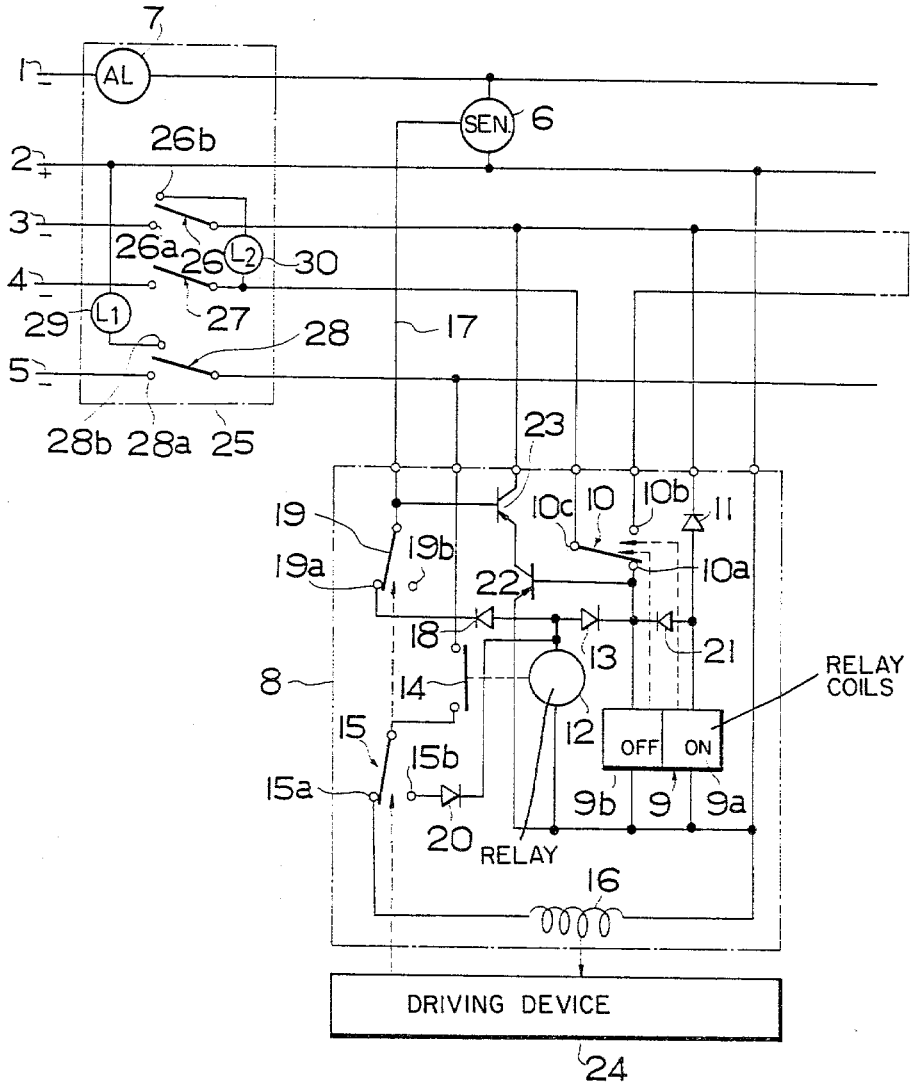
FIGS. 1 to 6 are schematic connection diagrams of six different embodiments of the present invention, wherein the same components are shown in the same numerals.

Referring now to FIG. 1, there is shown a preferred embodiment of the present invention. Numeral 1 denotes a sensor feed line, 2 a common return line, 3 a relay feed line, 4 a selective signal line, and 5 a load feed line, which are wired at a place necessary to supervise and control fire prevention devices in a building, a factory, a plant and so on. A plurality of sensors 6 are disposed in various places necessary to sense a condition and are connected in parallel to sensor feedline 1 and return line 2. Alarm device 7 is connected in series to the parallel circuit of sensors 6. A plurality of operating units 8 are disposed in places necessary to supervise and control the devices, and are connected, in multistage connection, to return line 2, relay feed line 3, selective signal line 4 and load feed line 5. Since sensors 6 and operating units 8 have respectively the same arrangement, FIG. 1 (similar to FIGS. 2 to 6) illustrates respectively only one.

Operating unit 8 is provided with self-maintaining relay 9 and its transfer contact 10. In the embodiment of FIG. 1, as self-maintaining relay 9, a two-coil type latch relay is used, which comprises first coil 9*a* to move an armature having a latch and second coil 9*b* to release the latch so that activation of first coil 9*a* causes transfer contact 10 to be connected to first terminal 10*a* and activation of second coil 9*b* causes transfer contact 10 to change over to second terminal 10*b*, and a simultaneous activation of both first and second coils 9*a*, 9*b* causes transfer contact 10 to be connected to first terminal 10*a* and deactivation of both coils 9*a*, 9*b* causes to change over to second terminal 10*b*.

First coil 9*a* of self-maintaining relay 9, and diode 11 are connected in series between return line 2 and relay feed line 3, while second coil 9*b* is connected between return line 2 and first terminal 10*a* of transfer contact 10. Common terminal 10*c* of transfer contact 10 is connected to the current source side of selective signal line 4, and second terminal 10*b* is connected to the next stage side of selective signal line 4, so that a plurality of operating units are connected in series to selective signal line 4.

Relay 12 and diode 13 are connected in series between return line 2 and first terminal 10*a*. Make contact 14 of relay 12, switch 15 (first terminal 15*a*) and solenoid 16 (as a load) are connected in series between return line 2 and load free line 5. The minus terminal of relay 12 is connected to signal line 17 of sensor 6, through diode 18 and switch 19 (first terminal 19*a*) in series, and second terminal 15*b* of switch 15 through diode 20. Diode 21 is connected between first coil 9*a* and first terminal 10*a*.

Transistors 22,23 are connected in series between return line 2 and relay feed line 3. The base of transistor 22 is connected to first terminal 10*a*, while the base of transistor 23 is connected to signal line 17.

Driving device 24, such as a cam arm to drive a fire prevention device (not shown), or as a latch for a lock, is actuated by activation of solenoid 16. The action of driving device 24 causes switches 15,19 to change over from first terminals 15*a*, 19*a* to second terminals 15*b*,19*b*.

Control port 25 is isolated from sensors 6 and operating units 8 so as to centrally supervise and control them. In control port 25, alarm device 7 is connected to sensor feed line 1, switch 26 to relay feed line 3, switch 27 to selective signal line 4, and switch 28 to load feed line 5. Second terminal 28*b* of switch 28 is connected to return line 2 through display device 29 such as a lamp, and second terminal 26*b* of switch 26 is connected to selective signal line 4 through display device 30. Relay feed line 3 and selective signal line 4 are connected in the ends.

The operation of the arrangement is as follows: When the circuit of sensor feed line 1, sensor 6 and return line 2 is completed by activation of sensor 6, alarm device 7 provides an alarm. A sensor signal (−) is also applied from sensor 6 to relay 12 through signal line 17, switch 19 and diode 18, and make contact 14 closes. When switch 28 is put to first terminal 28*a*, the circuit of load feed line 5, make contact 14, switch 15, solenoid 16 and return line 2 closes, and solenoid 16 actuates driving device 24.

In order to supervise the activation of sensor 6, a progressive scanning is performed using progressive operation means of the present invention. First, swtiches 27,28 are opened and switch 26 is closed to first terminal 26*a*. This causes first coils 9*a* of all self-maintaining relays 9 to be activated, and transfer contacts 10 to be connected to first terminal 10*a*. Then switch 26 is opened and switch 27 is closed so as to transmit a selective signal (−) to the first stage operating unit 8. The selective signal is applied to both first and second coils 9*a*, 9*b*, and self-maintaining relay 10 maintains the connection of first terminal 10*a*. When switch 26 is closed to position 26*b*, a supervisory signal is applied to display device 30 through return line 2, transistors 22,23, relay feed line 3 and switch 26 because transistors 22,23 are biased in the foward direction. Transistors 22,23 are forward biased by the sensor and selective (−) signals applied to the respective bases thereof by the above-mentioned actuation of corresponding sensor 6 and closure of switch 27. Thereby display device 30 displays whether sensor 6 has functioned. Thus, the supervision of the activation of sensor 6 is performed.

The selective signal is also applied to relay 12, and relay 12 closes make contact 14. If switch 28 is put in position 28*a*, solenoid 16 actuates driving device 24, in the case that solenoid 16 is not activated by a sensor signal. Thus the control of operating unit 8 is performed.

The actuation of driving device 24 causes switches 15,19 to change over to second terminals 15*b*,19*b*. When switch 28 is connected to second terminal 28*b*, the circuit of transfer contact 10 (first terminal 10*a*), diodes 13,20, switch 15, make contact 14, load feed line 5, switch 28, display device 29 and return line 2 is closed so that display device 29 indicates the closed position of driving device 24. Thus the supervision of the actuation of driving device 24 is performed.

Then switch 27 is opened to interrupt the selective signal. Both coils 9*a*,9*b* are deactivated, and transfer contact 10 changes over to second terminal 10*b*. Therefore, if switch 27 is closed again, the second selective signal is applied to the next stage operating unit in which the same operation is performed. This means that the alphabetical m-th operating unit is operated by transmission of the m-th selective signal. Thus progressive scanning and control are performed. After the last transfer contact 10 has changed over at the end of the operation, the next selective signal is applied to all the first coils 9*a* through selective signal line 4 and relay feed line 3 so that all the transfer contacts 10 change over to position 10*a* again.

In order to prevent all the driving devices 24 from acting by the operation of progressive scanning, switch 28 is opened during the procedure so as to interrupt the feed to solenoid 16. Similarly, switch 28 is opened to prevent malfunctions of solenoid 16 and driving device 24 due to errors of sensor 6. In this case, switch 28 is closed to activate solenoid 16 after the confirmation of the matter upon the activation of the alarm device 7.

In the foregoing arrangement, it is possible to connect one sensor 6 to a group of operating units 8, and to connect a group of some sensors to one operating unit 8. Also, it is permissible that there is a sensor not to be connected to an operating unit, or an operating unit not to be connected to a sensor. A non-contact relay or an electronical relay is useful as relay 12. Also, thyristors or relays may be used as transistors 22,23. As a load, motor or the like may be used instead of solenoid 16. The reverse polarity of the lines is also applicable.

Figure 2:
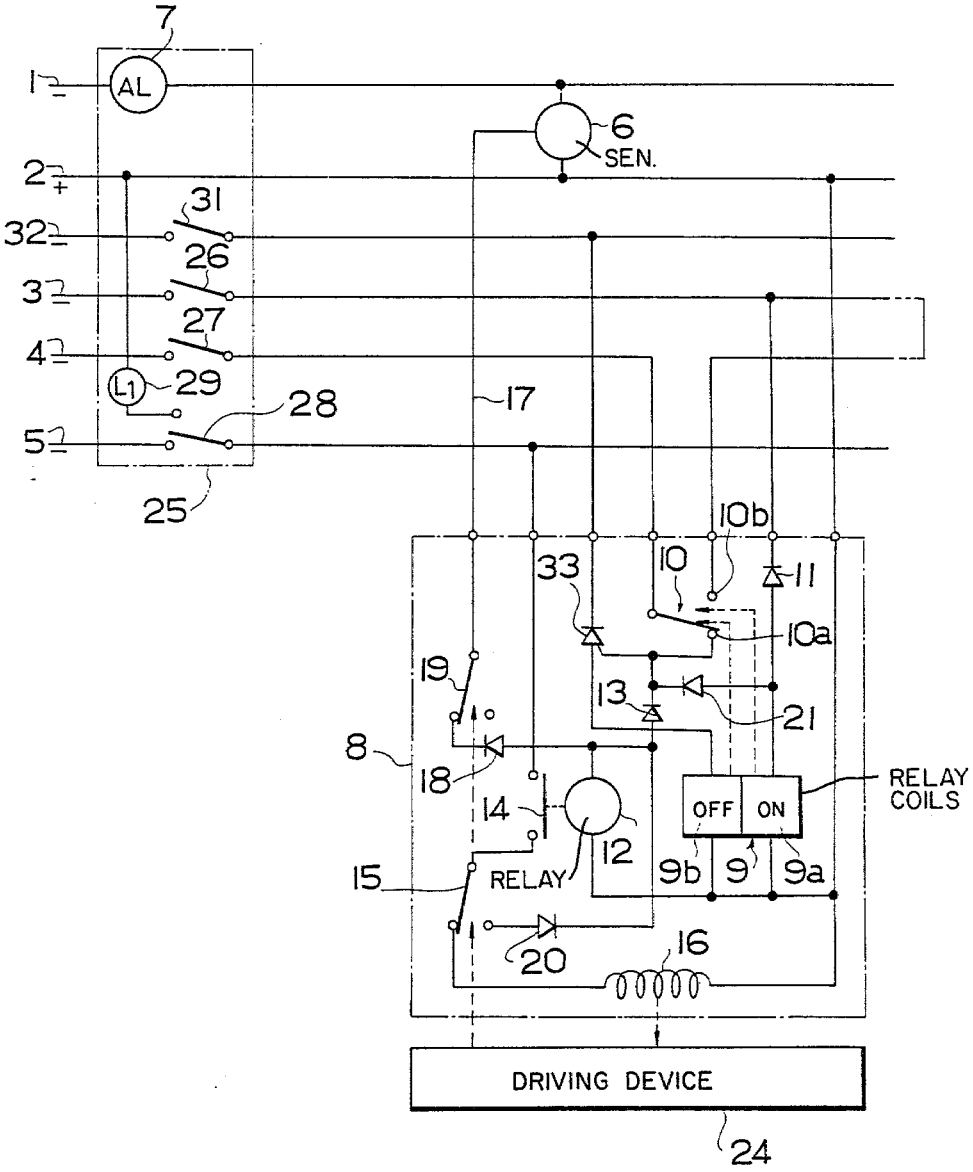

FIG. 2 shows a different embodiment having an arrangement similar to FIG. 1, in which a switch 31 is inserted in a reset line 32. Second coil 9*b* of self-maintaining relay 9 is connected to reset line 32 through an n-gate thyristor 33, the gate of which is connected to first terminal 10*a* of transfer contact 10. The transistor circuit in FIG. 1 is not illustrated.

The operation of the arrangement is the same as FIG. 1 except for the progressive mechanism. When switches 27,31 are closed, a selective signal is applied to first coil 9*a* of self-maintaining relay 9 through transfer contact 10 and diode 21, and transfer contact 10 is maintained in position 10*a*. Since the signal is also applied to relay 12 and the gate of thyristor 33, both relay 12 and thyristor 33 are activated. By the conduction of thyristor 33, second coil 9*b* is activated. However, transfer contact 10 is maintained in position 10*a* because first coil 9*a* has already been activated. Then, if switch 27 is opened to interrupt the selective signal, first coil 9*a* is deactivated; therefore, transfer contact 10 changes over to second terminal 10*b* by the action of thyristor 33 and second coil 9*b*.

In this embodiment, because second coil 9*b* is activated after the interruption of the selective signal, self-maintaining relay 9 may be any type of a two-coil relay such as a reed type relay which maintains the former position by simultaneous activations of the both coils. After transfer contact 10 changes over to second terminal 10*b*, thyristor 33 may be deactivated by opening switch 31.

In the embodiments illustrated in FIGS. 1 and 2, transfer contact 10 changes over when a selective signal has been interrupted. However, it is possible to change over the contact during transmission of a selective signal. In this case, it is necessary to allow a feed to a certain unit and to prevent to the other units during the transmission.

Figure 3:
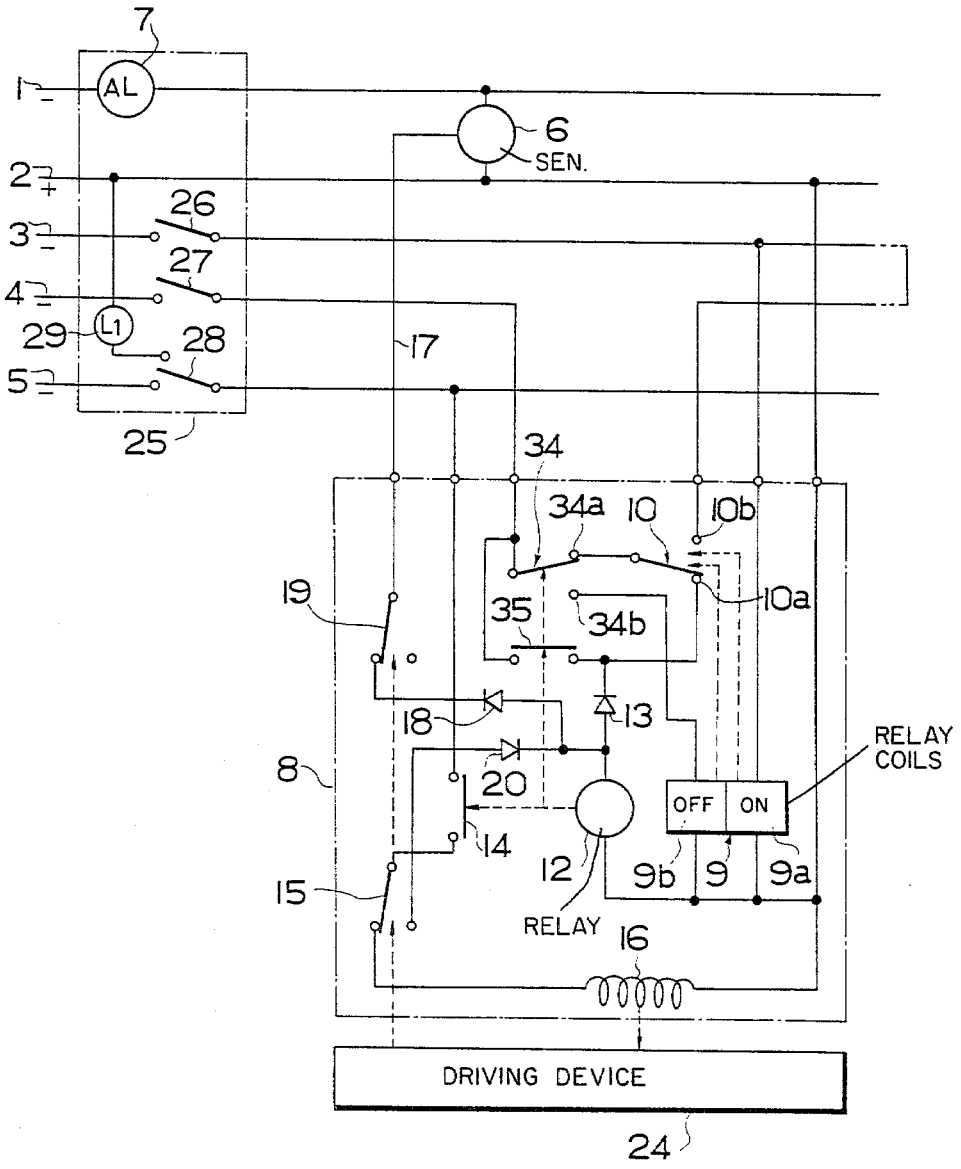

In FIG. 3, a transfer contact 34 of relay 12 is inserted between selective signal line 4 and transfer contact 10. Make contact 35 of relay 12, which early makes before the break of transfer contact 34, is inserted between selective signal line 4 and first terminal 10*a* of transfer contact 10.

In operation of the arrangement, when switch 27 is closed, relay 12 is activated and maintained by means of make contact 35. Then, transfer contact 34 changes over from first terminal 34*a* to second terminal 34*b*, and second coil 9*b* is activated. Then, transfer contact 10 changes over from first terminal 10*a* to second terminal 10*b*. Then, if switch 27 is opened, relay 12 is deactivated and make contact 35 and transfer contact 34 return to the original position (34*a*). In this arrangement, any type of a two-coil relay may be used as self-maintaining relay 9, because each coil 9*a*,9*b* is activated at a different time.

Figure 4:
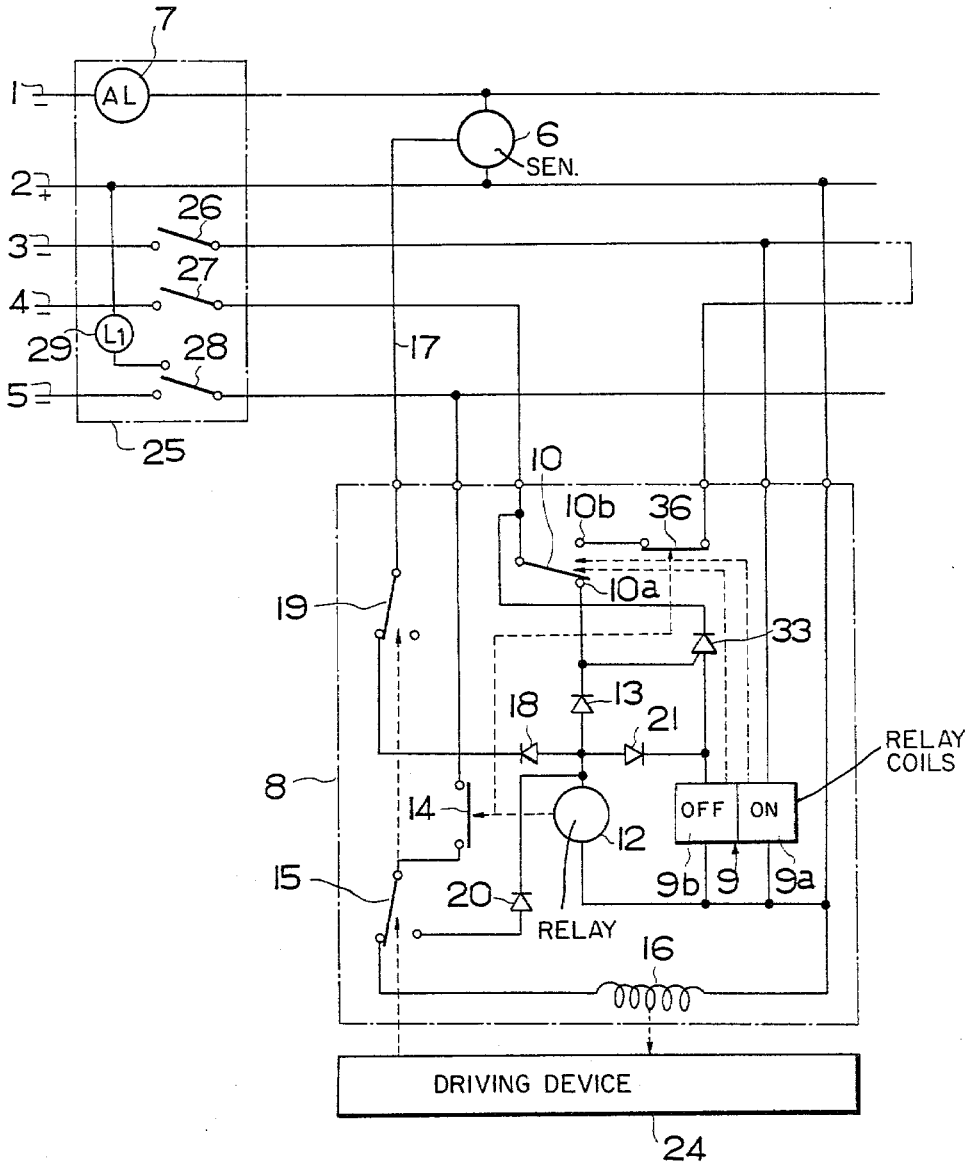

In FIG. 4, a break contact 36 of relay 12 is inserted between second terminal 10*b* of transfer contact 10, and selective signal line 4, and n-gate thyristor 33 is inserted between selective signal line 4 and second coil 9*b*. The gate of thyristor 33 is connected to first terminal 10*a* and the anode to relay 12 through diode 21.

In operation, a selective signal activates relay 12 and opens break contact 36. The selective signal is also applied to the gate of thyristor 33, and thyristor 33 is activated. Upon the activation of thyristor 33, second coil 9*b* is activated and transfer contact 10 changes over to second terminal 10*b*. In this connection, the selective signal is applied to relay 12 through thyristor 33 and diode 21; therefore, the activation of relay 12 continues after the change over of transfer contact 10. When the selective signal is interrupted, thyristor 33 and relay 12 are deactivated, and break contact 36 returns. The next selective signal is applied to the next operating unit.

Figure 5:
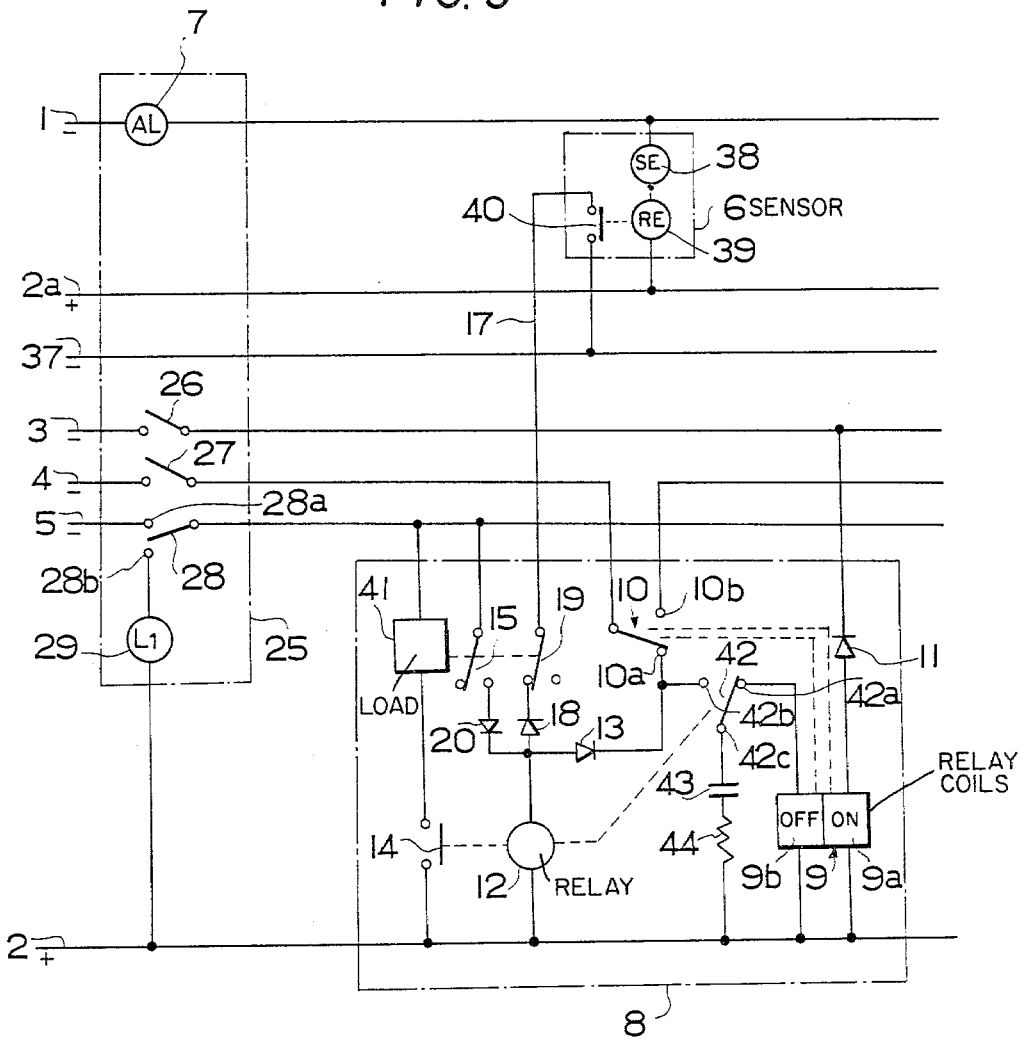

In FIG. 5, sensor return line 2*a* and sensor signal feed line 37 are provided independently. Sensor 6 comprises sensor element 38 and relay 39 having make contact 40. Sensor element 38 and relay 39 are connected in series between sensor feed line 1 and sensor return line 2*a*, and make contact 40 is connected to signal line 17 and sensor signal feed line 37. Load 41 and make contact 14 are connected in series between load feed line 5 and return line 2. Load 41 is illustrated instead of solenoid 16 in FIGS. 1 to 4. There is provided transfer contact 42 of relay 12, whose first terminal 42*a* is connected to second coil 9*b* of self-maintaining relay 9, second terminal 42*b* to first terminal 10*a* of transfer contact 10, and common terminal 42*c* to return line 2 through the series circuit of capacitor 43 and resistor 44.

In function, when sensor 6 functions, the circuit of sensor feed line 1, alarm device 7, sensor 6 and sensor return line 2*a* is completed. In this instance, sensor element 38 conducts a current, and relay 39 closes make contact 40. Then, a sensor signal is applied to relay 12 through sensor signal feed line 37, sensor 6 and signal line 17, and relay 12 closes make contact 14. Thereby load 41 is activated and changes over transfer contacts 15,19.

For the operation in control port 25, switch 26 is closed to activated first coil 9*a*, and transfer contact 10 changes over to first terminal 10*a*. When switch 26 is opened and switch 27 is closed, a selective signal activates relay 12 of first-stage operating unit 8, and make contact 14 closes. If switch 28 is in position 28*a*, load 41 is activated and transfer contacts 15,19 change over in the case that load 41 has not been activated by a sensor signal. By putting switch 28 in position 28*b*, the circuit of selective signal line 4, transfer contact 10, diodes 13,20, switches 15,28, display device 29 and return line 2 closes, and display device 29 displays the activation of load 41.

During the activation of relay 12, transfer contact 42 closes to second terminal 42*b*, and capacitor 43 charges. When switch 27 is opened, relay 12 is deactivated and transfer contact 42 returns to first terminal 42*a*. In this instance, capacitor 43 discharges through second coil 9*b* of self-maintaining relay 9; therefore, second coil 9*b* is activated and changes over transfer contact 10 to second terminal 10*b*. Then, switch 27 is closed again, the second selective signal is applied to the second-stage operating unit.

Figure 6:
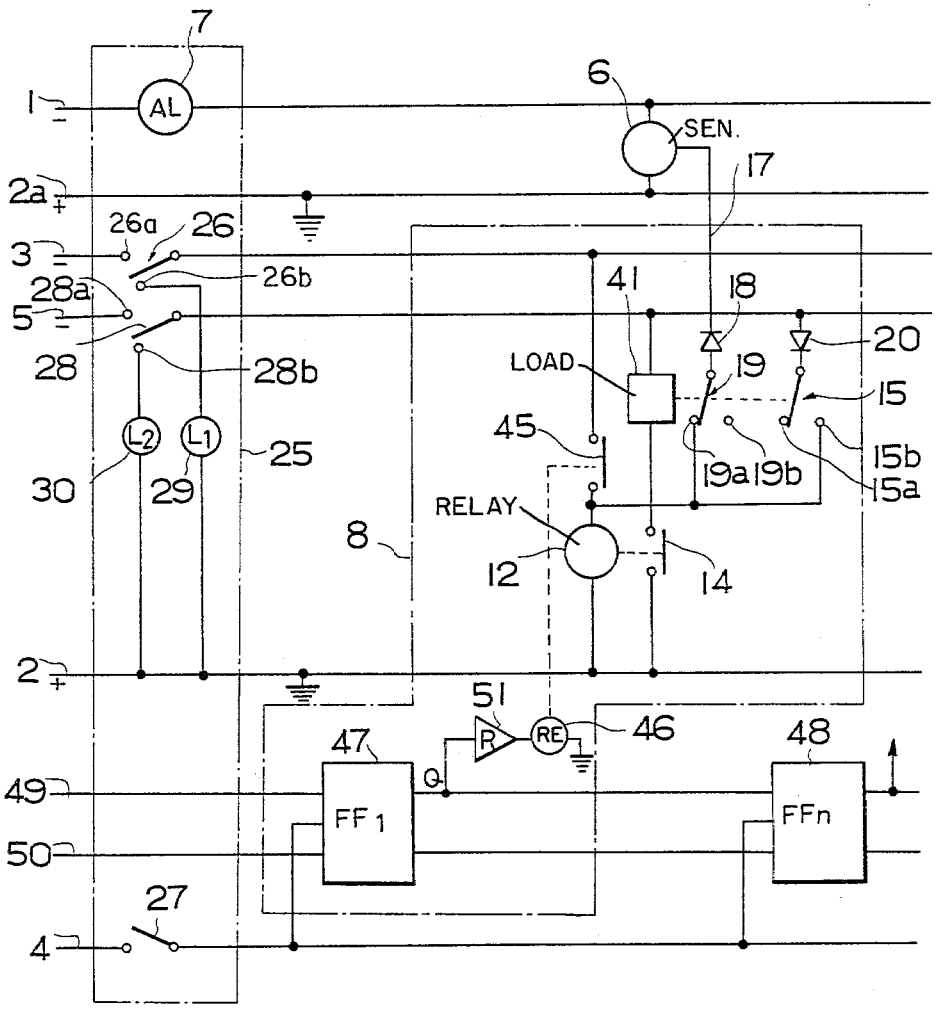

In the embodiment of FIG. 6, sensor 6 is connected to sensor feed line 1 and sensor return line 2*a*. Relay 12 and make contact 45 of another relay 46 are connected in series between relay feed line 3 and return line 2. First stage flip-flop 47 and the alphabetical n-th stage flip-flop 48 are connected in series to steering lines 49,50 and selective signal line 4 so as to constitute a shift register. First stage flip-flop 47 is provided in the first stage operating unit 8, and n-th stage flip-flop 48 in the n-th stage operating unit.

Since each flip-flop 47,48 is disposed in the field, it is preferable to use powerful flip-flops, or to annex a wave reforming circuit. Flip-flop 47,48 may be of the shift register type, R-S type of J-K type. The outputs of the shift register may be returned to steering lines 49,50 so as to constitute a circulating register or a ring counter. Relay driver 51 and relay 46 are connected to the output line of flip-flop 47.

In operation, a sensor signal applied to relay 12 through signal line 17 and switch 19 closes make contact 14 and activates load 41. In order to supervise the activation of sensor 6, switches 26,28 are put in position 26*b*, 28*b*, before operation. When a steering signal is applied to the first stage flip-flop 47 through steering line 49,50, and a selective signal (pulse) is applied through selective signal line 4 by means of switch 27, the output Q of the first stage flip-flop 47 is amplified by relay driver 51 and activates relay 46. Thereby relay 46 closes make contact 45 and a supervisory signal from sensor 6 is applied to display device 29 through make contact 45 and switch 26.

When it is necessary to activate load 41 after confirmation of the matter, switch 28 is put in position 28*a*. In order to activate load 41 in the case that sensor 6 has not functioned, switch 26,28 are put in position 26*a*,28*a*. Thereby relay 12 closes make contact 14, and load 41 is activated. The activation of load 41 causes switches 15,19 to change over to second terminals 15*b*,19*b*. Therefore, if switch 28 is put in position 28*b*, a supervisory signal is applied to display device 30 from relay feed line 3 through make contact 45 and switches 15,28, and display device 30 displays whether load 41 is activated.

When the next selective signal is applied from selective signal line 4, first stage flip-flop 47 is inverted and an output signal appears at the output line of the next stage flip-flop 48. Therefore, the same operation is performed in the next stage operating unit.

For the purpose of a sequential operation, it is advantageous to interlock alarm device 7, switches 26,27,28 and display devices 29,30 in the foregoing embodiments. In this case, it is preferable to use plurality of display devices corresponding to sensors 6 and operating units 8.

The supervisory control system and apparatus of the present invention are applicable to systems other than a fire prevention system, such as a burglar alarm system, a remote control system and so on.

It is to be understood that the present invention is not limited to the particular arrangements shown in the drawings but also comprises any modifications within the scope of the accompanying claims.

What is claimed is:

1. A supervisory control system comprising a plurality of sensors;

an alarm device for providing an alarm by activation of said sensors;

a series of operating units, a given one of said sensors being associated with a given one of said operating units for providing a sensor signal thereto when said one sensor is actuated, each operating unit comprising a relay for activating a load and transfer means for transferring the operatable state of its corresponding operating unit, said relay being connected for actuation by a selective signal and/or a sensor signal, and said transfer means being connected to allow the operation of its corresponding operating unit by a selective signal and to make possible the operation of the next operating unit by the next selective signal;

means for transmitting continual selective signals to said operating units; and display means for displaying information transmitted from said operating unit during the operation thereof.

2. A supervisory control system according to claim 1, further comprising means for interrupting the feed to said load.

3. A supervisory control system according to claim 1, in which said operating unit further comprises means for transmitting a supervisory signal.

4. A supervisory control system comprising a plurality of sensors;

an alarm device for providing an alarm by activation of said sensors;

a series of operating units, each operating unit comprising a relay for activating a load and transfer means for transferring the operatable state of its corresponding operating unit, said relay being connected for actuation by a selective signal and/or a sensor signal, and said transfer means being connected to allow the operation of its corresponding operating unit by a selective signal and to make possible the operation of the next operating unit by the next selective signal;

means for transmitting continual selective signals to saod operating units, said transfer means comprising a two-coil type self-maintaining relay having a transfer contact which is changed over by the transmission and/or the interruption of a said selective signal; and display means for displaying information transmitted from said operating unit during the operation thereof.

5. A supervisory control system according to claim 4, in which said transfer means further comprise a capacitor which charges during the transmission of a selective signal and discharges through a relay coil of said self-maintaining relay upon the interruption of the selective signal.

6. A supervisory control system according to claim 1, in which said transfer means are a shift register.

7. An apparatus for supervisory control comprising means actuable for generating at least one of a sensor signal and a selective signal;

a plurality of operating units each having a load for actuating a driving device, a relay for activating said load, said relay being connected for actuation by a selective signal and/or a sensor signal, and transfer means for transferring the operatable state of the operating unit, which allow the operation of such operating unit by a selective signal and make possible the operation of the next stage operating unit by the next selective signal; and means actuable for transmitting a supervisory signal during the operation of the operating unit.

8. A supervisory control system according to claim 1, in which said sensors are connected in parallel across first and second opposite potential lines, ones of said sensors being associated with ones of said operating units, said alarm device being connected in series in one of said first and second potential lines;

said selective signal transmitting means including a selective signal line and a selective signal switch actuable for connecting said selective signal line to said operating units;

means actuable for placing the transfer means of all of said operating units in initial condition;

said transfer means including a two-state transfer switch means in each of said operating units, said transfer switch means operatively interconnecting said selective signal line and said load activating relay of each operating unit for successively actuating the load actuating relays of successive operating units upon succesive actuations of said selective signal switch.

9. A supervisory control system according to claim 1, in which said sensors have respective output lines each energized in response to actuation of the corresponding sensor;

each of said operating units having a first load responsive switch which in the nonenergized condition of said load connects the output line of a corresponding sensor to the associated load activating relay in the operating unit for closing a make-contact of said load activating relay;

a load feed line and a load feed switch closable at a central control location for energizing said load through said closed make-contact in an operating unit connected to an actuated sensor.

10. A supervisory control system according to claim 9, in which said load includes a pair of switches responsive thereto and having two states corresponding to the unactuated state of the load, respectively, said first load responsive switch being connected in series between said sensor output line and said load activating relay in the nonactivated state of said load, the second load responsive switch in the activated state of said load establishing a series connnection of a load display device, said load feed switch, said second load responsive switch and a make-contact of said load activating relay.

11. A supervisory control system according to claim 9, including a sensor responsive display device connectible through a sensor supervisory switch through a line to all of said operating units, ones of said operating units including means responsive to the condition of the output line of a corresponding sensor and to selection of such operating unit by said selective signal for energizing said sensor responsive display device in response to actuation of the sensor connected to such operating unit.

* * * * *